United States Patent [19]

Shibayama et al.

[11] Patent Number: 4,632,638

[45] Date of Patent: Dec. 30, 1986

[54] REGULATOR VALVE FOR HYDRAULIC CONTROL SYSTEM INCLUDING VARIABLE DISPLACEMENT PUMP

[75] Inventors: Takashi Shibayama, Chigaskai; Kazuhiko Sugano, Yokohama, both of Japan

[73] Assignee: Nissan Motor Co., Ltd., Yokohama, Japan

[21] Appl. No.: 655,678

[22] Filed: Sep. 28, 1984

[30] Foreign Application Priority Data

Oct. 6, 1983 [JP] Japan ..... 58-185993

[51] Int. Cl.[4] ..... F04B 49/00

[52] U.S. Cl. ..... 417/218; 417/220; 137/625.69; 137/625.3

[58] Field of Search ..... 417/212, 218–222; 137/625.3, 625.69; 91/469

[56] References Cited

U.S. PATENT DOCUMENTS

| | | | |
|---|---|---|---|
| 3,186,353 | 6/1965 | Taplin | 417/218 |
| 3,423,136 | 1/1969 | Lohbauer | 137/625.3 X |
| 3,587,354 | 6/1971 | Oguma et al. | 137/625.3 X |
| 3,714,869 | 2/1973 | Flory et al. | 91/469 X |
| 3,945,764 | 3/1976 | Marietta | 417/212 |
| 4,065,228 | 12/1977 | McMillan | 417/212 |
| 4,289,452 | 9/1981 | Kubilos | 417/222 |
| 4,311,006 | 1/1982 | Becker | 137/625.3 X |
| 4,342,545 | 8/1982 | Schuster | 418/30 X |
| 4,344,285 | 8/1982 | Ridge | 417/218 X |
| 4,373,869 | 2/1983 | Martin et al. | 417/218 X |
| 4,474,104 | 10/1984 | Creffield | 417/221 X |
| 4,531,546 | 7/1985 | Barr | 137/625.69 |

FOREIGN PATENT DOCUMENTS

| | | | |
|---|---|---|---|
| 55-17696 | 2/1980 | Japan | 417/218 |

*Primary Examiner*—Carlton R. Croyle
*Assistant Examiner*—Paul F. Neils
*Attorney, Agent, or Firm*—Schwartz, Jeffery, Schwaab, Mack, Blumenthal & Evans

[57] ABSTRACT

In order to stabilize the line pressure developed by a line pressure regulator valve and simultaneously control the operation of a variable capacity pump in a manner that the latter exhibits the desired degree of response to changes in the line pressure, a flow restriction is defined in the bore of the valve itself. This flow restriction is defined between the wall of the bore in which the spool is disposed and a portion of the spool which extends between two adjacent lands and which has a diameter which is slightly smaller than that of the bore.

1 Claim, 1 Drawing Figure

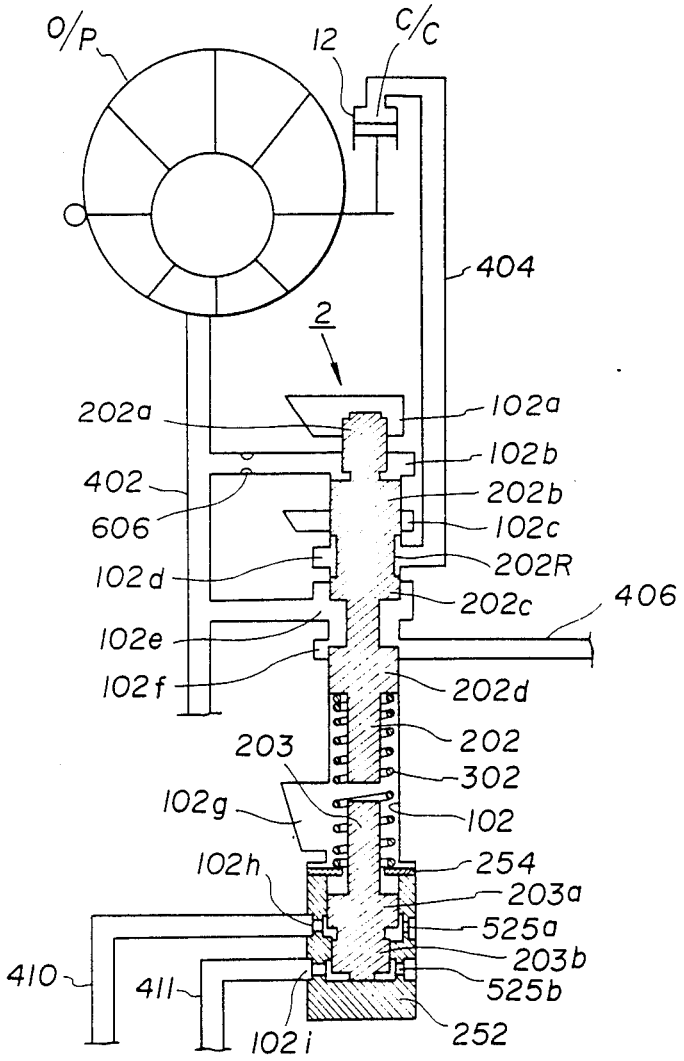
O/P
12
C/C
404
2
202a
102a
102b
402
202b
606
102c
202R
102d
202c
406
102e
102f
202d
202
203
302
102g
102
102h
254
203a
525a
203b
410
411
525b
252
102i

REGULATOR VALVE FOR HYDRAULIC CONTROL SYSTEM INCLUDING VARIABLE DISPLACEMENT PUMP

BACKGROUND OF THE INVENTION

The present invention relates to a hydraulic control system for an automotive automatic transmission and more specifically to a regulator valve for such a control system which includes a variable capacity pump.

DESCRIPTION OF THE PRIOR ART

In systems wherein a variable displacement pump is used in a hydraulic control circuit for effecting shifting between the various gear ratios of an automotive automatic transmission, a problem has been encountered in that as the pump is controlled via a feedback pressure developed by the regulator valve, in order to avoid fluctuations in the line pressure it is necessary to damp the feedback pressure fed to the control chamber of the variable capacity pump. A previously proposed method of achieving the above end is to place a fixed flow restriction or orifice in the conduit leading from the regulator valve to the control chamber of the pump. However, this particular technique has not met with success in that the response of the pump to the changes in the line pressure developed by the regulator valve is unacceptably out of phase with the actual changes in the line pressure and leads accordingly to degraded line pressure control.

An example of the above hydraulic control circuit for an automotive automatic transmission is disclosed in U.S. patent application Ser. No. 591,849 filed on Mar. 21, 1984 in the name of Ideta (or the corresponding European Patent Application No. 84103198.2 filed on Mar. 22, 1984 in the name of Nissan Motor Co.). The content of this document is hereby incorporated by reference thereto.

SUMMARY OF THE INVENTION

It is an object of the present invention to provide a regulator valve which includes a unique flow restriction arrangement which enables the control of a variable capacity pump in a manner that the desired level of line pressure can be maintained without undesirable pressure fluctuations or loss of phase between the pressure developed by the valve and the pressure applied to the control chamber of the pump.

In brief, the above object is achieved by an arrangement wherein in order to stabilize the line pressure developed by a line pressure regulator valve and simultaneously control the operation of a variable capacity pump in a manner that the latter exhibits the desired degree of response to changes in the line pressure, a flow restriction is defined in the bore of the valve itself. This flow restriction is defined between the wall of the bore in which the spool is disposed and a portion of the spool which extends between two adjacent lands and which has a diameter which is only slightly smaller than that of the bore.

In its broadest aspect the present invention takes the form of a system having a valve which comprises: a bore formed with first, second and third ports, the first port communicating with a source of fluid under pressure, the second port fluidly communicating with a servo device, and the third port communicating with a drain; a spool reciprocatively disposed in the bore, the spool having first and second lands, the first land controlling fluid communication between the first and second ports and the second land controlling fluid communication between the second and third ports; and means defining a flow restriction within the bore for restricting fluid communication between the first and second ports and the second and third ports.

A more specific aspect of the present invention comes in a hydraulic control system for an automotive automatic transmission which features: a variable capacity pump for supplying fluid under pressure, the pump having a control arrangement including a control chamber which varies the capacity of the pump in response to the pressure prevailing therein; a pressure regulator valve for regulating the output of the pump by draining off some of the the fluid discharged by the pump and developing a control pressure, the regulator valve including a bore formed with: a first port which receives the output of the pump, a second port which fluidly communicates with the control chamber, and a drain port, the regulator valve further including a spool which is reciprocatively disposed in the bore and which is formed with first and second lands, the first land controlling communication between the first and second ports and the second land controlling communication between the second and third ports; and means within the bore for defining a fixed flow restriction which restricts fluid communication between the first and second port and the second and third ports, the flow restriction being defined by an opening between the wall of the bore and the portion of the spool which extends between the first and second lands and which has a diameter which is marginally less than the diameter of that portion of the bore in which it is disposed.

BRIEF DESCRIPTION OF THE DRAWING

The features and advantages of the arrangement of the present invention will become more clearly appreciated from the following description taken in conjunction with the accompanying drawings wherein the same numerals as used in the above incorporated document to denote like parts and in which:

The FIGURE is a schematic sectional view showing an embodiment of the present invention.

DETAILED DESCRIPTION OF THE PREFERRED EMBODIMENTS

The FIGURE shows an embodiment of the present invention. In this arrangement the regulator valve 2 comprises a valve bore 102 formed with nine ports **102*a* to 102*i* and a spool 202 having formed thereon four lands 202*a* to 202*d* slidably disposed in the valve bore 102. It also comprises a stationary sleeve 252, formed with two ports 525*a* and 525*b*, fixed relative to the valve bore 102, a spool 203 having formed thereon lands 203*a* and 203*b* slidably disposed in said stationary sleeve 252, a spring 302 arranged between the land 202*d* of the spool 202 and a spring seat 254 mounted on the upper end of the sleeve 252. The lands 202*b*, 202*c* and 202*d* have the same diameter while land 202*a* is smaller in diameter than the former. The land 203*a* of the spool 203 is larger in diameter than the land 203*b*. Ports 102*a*, 102*c* and 102*g* are drain ports. The ports 102*b* and 102*e* are connected with a conduit 402 (the line pressure circuit). An orifice 606 is provided in port 102*b* to damp the communication between the pump O/P and the said port 102*b* via conduit 402**.

In this arrangement the pump O/P is a vane pump of the variable volume discharge type and is designed to decrease the discharge rate of the oil flow in response to pressure supplied to the oil chamber C/C. Port 102*f* is connected via a conduit 406 with a torque converter pressure reducing or limiting valve (not shown). Port 102*h* is connected via a conduit 410 with a cut back valve, while port 102*i* is connected via a conduit 411 with the cut back valve and a pressure modifier valve (both not shown). Conduit 411 serves to supply a pressure which modifies the line pressure when the vehicle is starting from standstill, while the pressure fed to the regulator valve via conduit 410 is arranged to modify the line pressure when the vehicle is operated in reverse gear. Therefore, the line pressure is regulated in response to the oil pressure in conduit 410 and that in conduit 411.

The regulator valve 2 functions to regulate the line pressure in conduit 402 as follows. The hydraulic pressure introduced from the pump via port 102*b* acts on a differential area between the lands 202*a* and 202*b* of the spool 202, exerting a downward force (as seen in the FIGURE) on the spool 202. On the other hand, the spool 202 is subject to the sum of an upward force provided by the spring 302 and another upward force (described hereinlater) acting on the spool 203. Since the hydraulic fluid supplied to the port 102*e* is discharged via port 102*f*, the hydraulic pressure in port 102*b* is regulated to a value at which the downward force created by the oil pressure in port 102*b* establishes an equilibrium with the sum of the two upward forces.

If, as a result of an increase in the pressure in port 102*b*, the downward force increases above the sum of the upward forces, the spool 202 moves slightly downward, forming a clearance (which acts as a variable orifice) between the land 202*d* and port 102*f*, allowing the hydraulic fluid in port 102*e* to flow via this clearance to the port 102*f* resulting in a reduction in the pressure in port 102*e*. This pressure reduction in turn results in a reduction in the pressure prevailing in port 102*b* which communicates via conduit 402 with port 102*e*. The reduction in the oil pressure in port 102*b* causes a reduction in the downward acting force, allowing the spool 202 to move upward. This action is repeated continuously whereby the pressure in port 102*b*, i.e., the pressure in the conduit 402 is regulated to a value at which the downward force always balances with the sum of the upward forces. The pressure regulated in this manner (viz., the line pressure) is variable with the upward force applied by the spool 203 because the force exerted by spring 302 is constant.

As shown, ports 102*h* and 102*i* of the valve bore 102 register with ports 525*a* and 525*b* of the sleeve 252, respectively. This permits the pressure in conduit 410 acting on a differential area between the lands 203*a* and 203*b* of the spool 203 and the pressure in conduit 411 to act on the bottom end of the land 203*b*, creating the previously mentioned upward force with which the spool 203 urges the spool 202 upward. Therefore, the line pressure is regulated in response to the pressure in conduits 410 and 411.

The pressure prevailing in the control chamber C/C of cylinder 12 is controlled as follows. When the volume of hydraulic fluid discharged by the pump O/P exceeds that required, the net pressure in conduits 410 and 411 increases. The spool 202 thus tends to move upwardly to establish a clearance between land 202*b* and drain port 102*c*. This clearance acts as first a variable orifice through which fluid flows to drain port 102*c*. This induces a reduction in the pressure prevailing in the control chamber C/C by venting some of the pressure out through the drain. The piston received in the cylinder 12 is accordingly caused to move upwardly as seen in the drawings. This decreases the eccentricity of the pump O/P and reduces the output thereof. Conversely, if the amount of hydraulic fluid discharged by the pump O/P falls below the level required, the net pressure in conduits 410 and 411 decreases. In this instance, the spool 202 moves downwardly establishing communication between ports 102*d* and 102*e* while cutting off communication between ports 102*d* and 103*c*. The pressure prevailing in the control chamber C/C of the control cylinder 12 accordingly increases moving the piston in a direction which increases the eccentricity of the pump and therefore the displacement capacity thereof.

The section 202R of the spool between the lands 202*b* and 202*c*, in this embodiment is arranged to have a diameter which is sufficiently large as to define a narrow annular cross section space which functions as a fixed flow restriction, between it and the wall of the bore 102. Experiments have shown that the width of the gap between the wall of the bore and the outer periphery of the spool section 202R should not exceed 1.5 mm in order to provide the desired orifice effect.

Accordingly, when the spool 202 moves upwardly under the influence of excessive pump discharge, ports 102*d* and 102*c* communiate via this flow restricting space. This, in combination with the variable orifice effect provided by the clearance between land 202*b* and port 202*c* obviates the excessive flow rates which would tend to occur in the absence of the fixed flow restriction, and thus damps the rate at which fluid is vented from chamber C/C. Similarly, when the discharge of the pump becomes insufficient and the spool 202 moves downwardly, the communication between ports 102*e* and 102*d* is established by a second variable orifice, and similarly restricted by the fixed flow restriction. Thus damping the rate at which pressure is fed to the control chamber C/C.

The above described arrangement eliminates the hunting phenomenon exhibited by the arrangement wherein a fixed orifice is disposed in the conduit leading to control chamber of the pump.

What is claimed is:

1. In a hydraulic control system for an automotive automatic transmission, an automatic transmission actuated by hydraulic fluid;

a variable capacity pump for supplying hydraulic fluid under pressure for actuating the automatic transmission, said pump having a control arrangement including a control chamber which varies the capacity of said pump in response to the pressure prevailing therein;

a pressure regulator valve for regulating the output of said pump by draining off some of the fluid discharged by said pump and developing a control pressure, said regulator valve including a bore formed with:

a first port which receives the output of said pump, a second port which fluidly communicates with said control chamber, and a drain port, said regulator valve further including a spool which is reciprocatively disposed in said bore and which is formed with first and second lands, said first land defining a first variable orifice between said first and second ports and said second land defining a second variable orifice between said second and drain ports; and a fixed flow restriction within said bore, for restricting fluid communication between said first and second ports and said second and drain ports, said fixed flow restriction being defined between the wall of said bore and a first portion of said spool which extends between said first and second lands, said portion having a diameter which is selected with respect to the diameter of that portion of the bore in which it is disposed so as to define a gap having a maximum width of 1.5 mm.

* * * * *